US011226145B2

(12) United States Patent
Seong et al.

(10) Patent No.: US 11,226,145 B2
(45) Date of Patent: Jan. 18, 2022

(54) REFRIGERATOR AND METHOD FOR CONTROLLING A COMPRESSOR BASED ON TEMPERATURE OF STORAGE COMPARTMENT

(71) Applicant: LG ELECTRONICS INC., Seoul (KR)

(72) Inventors: Giseok Seong, Seoul (KR); Yoonseong Nam, Seoul (KR); Yonghun Suh, Seoul (KR); Myungjin Chung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 69 days.

(21) Appl. No.: 16/694,539

(22) Filed: Nov. 25, 2019

(65) Prior Publication Data

US 2020/0166259 A1 May 28, 2020

(30) Foreign Application Priority Data

Nov. 26, 2018 (KR) ..... 10-2018-0147448

(51) Int. Cl.
*F25B 49/02* (2006.01)
*F25D 17/06* (2006.01)
(Continued)

(52) U.S. Cl.
CPC ..... *F25B 49/022* (2013.01); *F25B 49/02* (2013.01); *F25D 11/022* (2013.01);
(Continued)

(58) Field of Classification Search
CPC ..... F25B 49/02; F25B 49/022; F25D 11/022; F25D 29/00; F25D 2700/12
See application file for complete search history.

(56) References Cited

U.S. PATENT DOCUMENTS 5,261,247 A * 11/1993 Knezic ..... F25D 11/022 62/117
2010/0082160 A1 4/2010 Kondou et al.
(Continued)

FOREIGN PATENT DOCUMENTS

CN 101617185 A 12/2009
CN 102536767 A 7/2012
(Continued)

OTHER PUBLICATIONS

Extended European Search Report dated Apr. 2, 2020 issued in Application EP 19 21 1617.
(Continued)

*Primary Examiner* — Jonathan Bradford
(74) *Attorney, Agent, or Firm* — KED & Associates, LLP

(57) ABSTRACT

A method for controlling a refrigerator includes turning on a compressor to operate with a predetermined cooling power for cooling a storage compartment, turning off the compressor when a temperature of the storage compartment reaches a temperature equal to or lower than a first reference temperature, and turning on the compressor again when the temperature of the storage compartment reaches a temperature equal to or higher than a second reference temperature higher than the first reference temperature. In the turning on the compressor again, the compressor is operated with a cooling power determined based on an on slope, which is a temperature change slope of the storage compartment during an on time of the compressor, and an off slope, which is a temperature change slope of the storage compartment during an off time of the compressor.

19 Claims, 7 Drawing Sheets

(51) Int. Cl.
*F25D 29/00* (2006.01)
*F25D 11/02* (2006.01)

(52) U.S. Cl.
CPC ..... *F25D 17/067* (2013.01); *F25D 29/00* (2013.01); *F25B 2400/077* (2013.01); *F25B 2500/08* (2013.01); *F25B 2600/0251* (2013.01); *F25B 2600/2511* (2013.01); *F25B 2700/151* (2013.01); *F25B 2700/2104* (2013.01); *F25D 2600/06* (2013.01); *F25D 2700/12* (2013.01)

(56) References Cited

U.S. PATENT DOCUMENTS

| | | | | |
|---|---|---|---|---|
| 2010/0095691 | A1 | 4/2010 | Kondou et al. | |
| 2012/0017615 | A1 | 1/2012 | Beers et al. | |
| 2012/0210737 | A1 | 8/2012 | Giardino et al. | |
| 2014/0124158 | A1* | 5/2014 | Yamashita | F25D 31/00 165/10 |
| 2016/0265829 | A1* | 9/2016 | Park | F25D 11/00 |

FOREIGN PATENT DOCUMENTS

| | | | |
|---|---|---|---|
| CN | 102589094 | A | 7/2012 |
| EP | 1 990 591 | A1 | 11/2008 |
| JP | S59 97442 | A | 6/1984 |
| JP | S59 97444 | A | 6/1984 |
| JP | H05 340659 | A | 12/1993 |
| JP | 2013-181702 | A | 9/2013 |
| JP | WO 2013/128898 | A1 | 9/2013 |
| KR | 10-1652523 | | 8/2016 |

OTHER PUBLICATIONS

Chinese Office Action dated May 6, 2021 issued in Application 201911176249.7.
Chinese Notice of Allowance dated Nov. 12, 2021 issued in CN Application No. 201911176249.7.

* cited by examiner

REFRIGERATOR AND METHOD FOR CONTROLLING A COMPRESSOR BASED ON TEMPERATURE OF STORAGE COMPARTMENT

CROSS-REFERENCE TO RELATED APPLICATION

The present application claims priority under 35 U.S.C. § 119 and 35 U.S.C. § 365 to Korean Patent Application No. 10-2018-0147448, filed in Korea on Nov. 26, 2018, which is hereby incorporated by reference in its entirety.

BACKGROUND

Field

The present disclosure relates to a refrigerator and a method for controlling the same.

2. BACKGROUND

Refrigerators are home appliances for storing foods at a low temperature. It may be essential to always maintain a storage compartment at a constant low temperature.

The refrigerator uses a cooling cycle in order to maintain the temperature of the storage compartment at a low temperature. The cooling cycle may include a compressor, a condenser, an expander, and an evaporator, for example. The temperature of the storage compartment may be adjusted by controlling the compressor.

Korean Patent Registration No. 10-1652523, the subject matter of which is incorporated herein by reference, discloses a refrigerator in which a cooling power of a compressor is determined according to room temperature, which is a temperature of a space where a refrigerator is installed.

The cooling power may be an input power that is inputted to the compressor, and may be defined as a power value required for the compressor to adjust the cooling power of the refrigerator.

However, in the Korean Patent Registration No. 10-1652523, the cooling power of the compressor is determined according to the temperature outside the refrigerator (external load) and the compressor is driven, and thus there may be a problem in that an optimum cooling power of the compressor must be determined through experiments for each product and condition of the refrigerator.

Additionally, the cooling power of the compressor may be determined with respect to each certain temperature range. Since the cooling power of the compressor is set to be slightly larger than the required cooling power within the temperature range, the compressor may be driven with a cooling power that is higher than necessary. Therefore, a section where energy is wasted may exist.

BRIEF DESCRIPTION OF THE DRAWINGS

Arrangements and embodiments may be described in detail with reference to the following drawings in which like reference numerals refer to like elements and wherein.

DETAILED DESCRIPTION

Exemplary embodiments of the present disclosure may be described below in detail with reference to the accompanying drawings in which the same reference numbers are used throughout this specification to refer to the same or like parts. In describing the present disclosure, a detailed description of known functions and configurations may be omitted when it may obscure the subject matter of the present disclosure.

It may be understood that, although the terms first, second, A, B, (a), (b), etc. may be used herein to describe various elements of the present disclosure, these terms are only used to distinguish one element from another element and essential, order, or sequence of corresponding elements are not limited by these terms. It may be understood that when one element is referred to as "being connected to", "being coupled to", or "accessing" another element, one element may "be connected to", "be coupled to", or "access" another element via a further element although one element may be directly connected to or may directly access another element.

Figure 1:
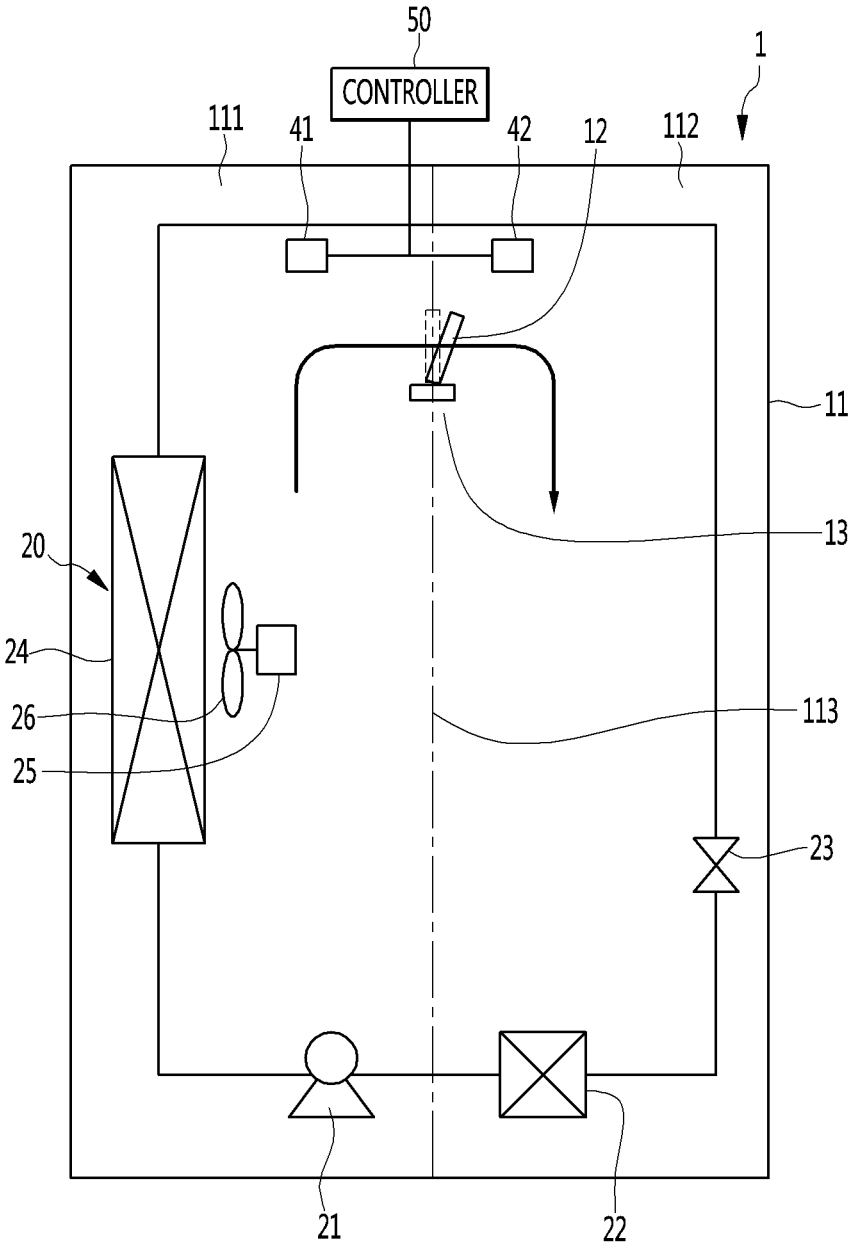
FIG. 1 is a view schematically showing a configuration of a refrigerator according to an example embodiment of the present disclosure.
Figure 2:
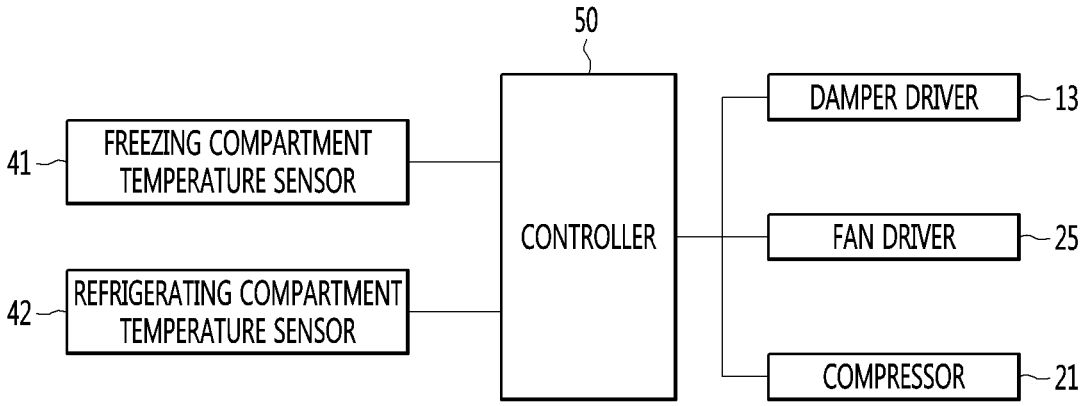
FIG. 2 is a block diagram of a refrigerator according to an example embodiment of the present disclosure.

FIG. 1 is a view schematically showing a configuration of a refrigerator according to an example embodiment of the present disclosure. FIG. 2 is a block diagram of a refrigerator according to an example embodiment of the present disclosure. Other embodiments and configurations may also be provided.

Referring to FIGS. 1 and 2, a refrigerator 1 according to an example embodiment may include a cabinet 11 having a freezing compartment 111 and a refrigerating compartment 112 formed therein and a door coupled to the cabinet 11 to open and close each of the freezing compartment 111 and the refrigerating compartment 112.

The freezing compartment 111 and the refrigerating compartment 112 may store an object such as food.

The freezing compartment 111 and the refrigerating compartment 112 may be partitioned by a partitioning wall 113 inside the cabinet 11 in a horizontal or vertical direction.

The partitioning wall 113 may include a cooling air hole, and a damper 12 may be installed in a connection duct to open or close the cooling air hole.

The refrigerator 1 may include a cooling cycle 20 (or cooling cycle components) for cooling the freezing compartment 111 and/or the refrigerating compartment 112.

The cooling cycle 20 may include a compressor 21 for compressing refrigerant, a condenser 22 for condensing refrigerant passing through the compressor 21, an expansion member 23 (or expansion device) for expanding refrigerant passing through the condenser 22, and an evaporator 24 for evaporating refrigerant passing through the expansion member 23. The evaporator 24 may include a freezing compartment evaporator, for example.

The refrigerator 1 may include a fan 26 for enabling air to flow toward the evaporator 24 for circulation of cool air in the freezing compartment 111, and a fan driver 25 (or fan motor) for driving the fan 26.

In the present example embodiment, the compressor 21 and the fan driver 25 may operate to supply cool air to the freezing compartment 111. However, not only the compressor 21 and the fan driver 25 may operate, but also the damper 12 may be opened in order to supply cool air to the refrigerating compartment 112. At this time, the damper 12 may operate based on a damper driver 13 (or damper motor).

In this disclosure, the compressor 21, the fan driver 25 and the damper 12 (and/or the damper driver 13) may be referred to as a "cool air supply means" (or cool air supply system) which operates to supply cool air to the storage compartment. The cool air supply system (or means) may include a plurality of components to supply cool air to the storage compartment.

The refrigerator 1 may include a freezing compartment temperature sensor 41 for sensing temperature of the freezing compartment 111, a refrigerating compartment temperature sensor 42 for sensing temperature of the refrigerating compartment 112, and a controller 50 for controlling the cool air supply means based on the temperatures sensed by the temperature sensors 41 and 42. At least a part of the controller 50 may include hardware for performing operations and/or communicating with other components.

The controller 50 may control cooling power of the compressor 21 in order to maintain the temperature of the freezing compartment 111 at a set temperature (or target temperature).

The controller 50 may control one or more of the compressor 21, the fan driver 25 and the damper driver 13 in order to maintain the temperature of the refrigerating compartment 112 at a set temperature (or other temperatures).

For example, the controller 50 may adjust an opening angle of the damper 12 while the compressor 21 and the fan driver 25 operate with a constant output.

The set temperature range of the storage compartment may refer to a range between a first reference temperature (which is lower than the set temperature) and a second reference temperature (which is higher than the set temperature). Controlling the temperature of the storage compartment to be maintained within the set temperature range may be referred to as constant temperature control of the storage compartment.

A temperature between the first reference temperature and the second reference temperature may be referred to as a third reference temperature.

In one example, the third reference temperature may be a set temperature of the storage compartment or an average temperature of the first reference temperature and the second reference temperature, but is not limited thereto.

For example, the controller 50 may control the on/off of the compressor 21 such that the temperature of the freezing compartment 111 is maintained within the set temperature range. The controller 50 may control the compressor 21 to be in an ON state or to be in an OFF state. The ON state may be a state in which the compressor 21 is operating. The OFF state may be a state in which the compressor 21 is not operating.

For example, the controller 50 may turn on the compressor 21 when the temperature of the freezing compartment 111 is higher than or equal to the second reference temperature.

When the compressor 21 is turned on, the temperature of the freezing compartment 111 is lowered. When the temperature of the freezing compartment 111 decreases to reach the first reference temperature, then the compressor 21 may be turned off (in response to reaching the first reference temperature).

As described above, the compressor 21 may be repeatedly turned on and off. A ratio of on time of the compressor 21 to a sum of on time and off time of the compressor 21 may be referred to as an operation rate of the compressor 21.

The operation rate of the compressor 21 may be predetermined and stored in the memory 44. The operation rate of the compressor 21 may or may not be variable according to the type of the refrigerator 1.

The controller 50 may obtain temperature change information of the storage compartment during operation of the compressor 21, compare the obtained temperature change information with the operation rate of the compressor 21, and determine the cooling power of the compressor 21 to operate during a next time (or during a next time period in the future).

As one example, the refrigerator 1 may include a single storage compartment and a single evaporator. For example, the refrigerator 1 may be a refrigerator that includes a refrigerating compartment.

Alternatively, the refrigerator 1 may be a wine refrigerator or a freezer that includes only a freezing compartment. The single storage compartment may be divided into a plurality of spaces by shelves.

Figure 3:
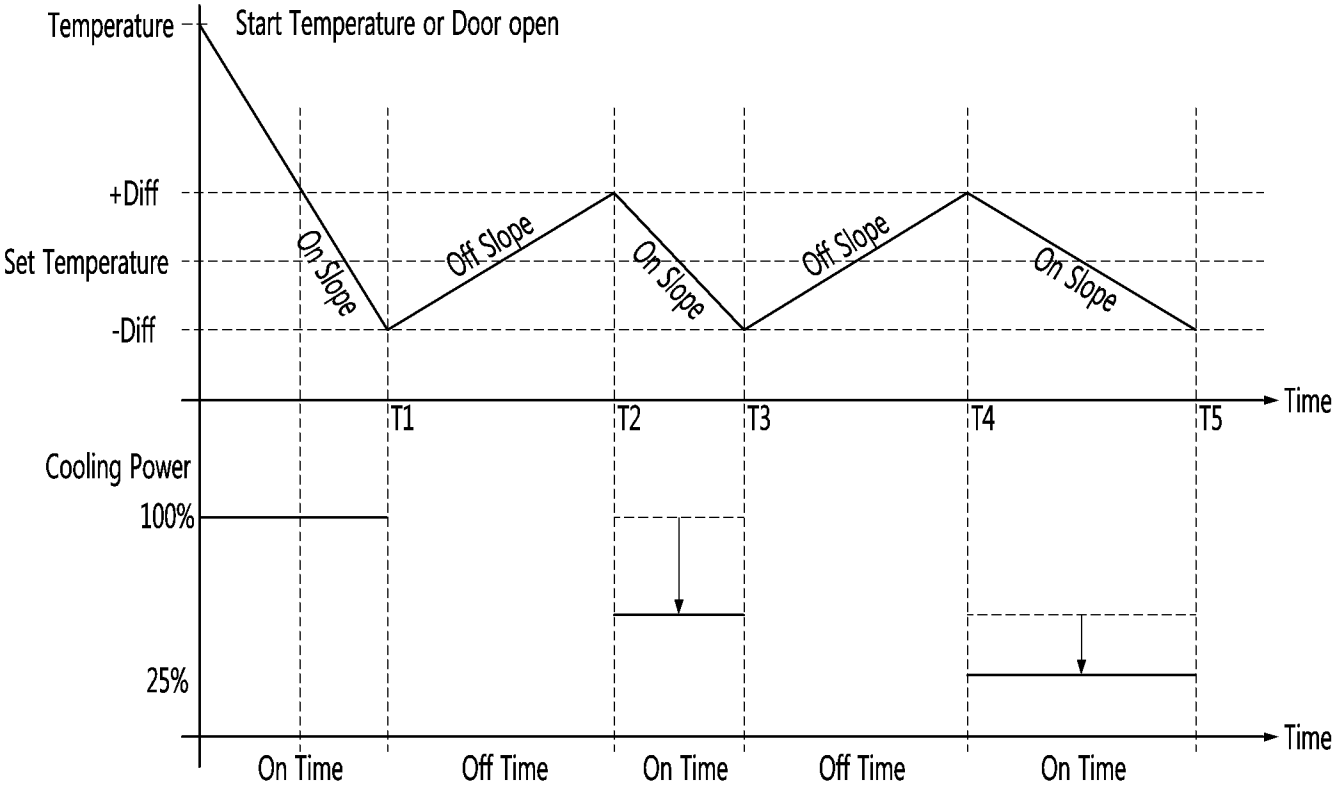
FIG. 3 is a view for describing a change in cooling power of a compressor according to a temperature change of a storage compartment according to an example embodiment of the present disclosure.

FIG. 3 is a view for describing a change in cooling power of the compressor according to a temperature change of a storage compartment according to an example embodiment of the present disclosure. Other embodiments and configurations may also be provided.

Referring to FIG. 3, the cooling cycle 20 may start in order to cool the storage compartment.

When the cooling cycle 20 is started, the compressor 21 may operate with a predetermined cooling power.

For example, when the power of the refrigerator 1 is turned on (or when the door is opened), the temperature of the storage compartment may be higher than the second reference temperature (+Diff).

In this example, since it is necessary to quickly lower the temperature of the storage compartment, the controller 50 may control the compressor 21 to operate at the maximum cooling power (or new maximum cooling power). FIG. 3 shows the maximum cooling power as 100%.

While the compressor 21 is operating at the maximum cooling power, the temperature of the storage compartment may decrease and become lower than (or less than) the second reference temperature, and is the temperature may continuously lower.

When the temperature of the storage compartment becomes equal to or lower than (or less than) the first reference temperature (−Diff), the controller 50 may control the compressor 21 to turn off.

The controller 50 may obtain (or determine) a temperature change slope (hereinafter referred to as an on slope or on slope value) of the storage compartment during the time (or time period) when the compressor 21 is turned on. The temperature change slope is based on the temperature and the time. More specifically, the on slope may be determined based on a change of temperatures and a change of time. In calculations or determinations that involve slopes (such as an on slope), a magnitude of the on slope may be used.

Additionally, the controller 50 may obtain (or determine) a temperature change slope (hereinafter referred to as an off slope or an off slope value) of the storage compartment during the time (or time period) when the compressor 21 is turned off. More specifically, the off slope may be determined based on a change of temperatures and a change of time. In calculations or determinations that involve slopes (such as an off slope), a magnitude of the off slope may be used.

The controller 50 may obtain (or determine) a slope ratio, which is a ratio of the on slope to the off slope. The slope ratio may be shown as the following:

|on slope/off slope|

The controller 50 may determine the cooling power of the compressor 21 for when the compressor 21 is turned on a next time (or a next time period) based on the slope ratio and the reference operation rate (hereinafter referred to as "r").

For example, the controller 50 may determine the cooling power of the compressor 21 by comparing the slope ratio with a reference value (r/(1−r)).

The cooling power of the compressor 21 may be maintained or varied, and the cooling power of the compressor 21 may be equal to or close to the optimum cooling power through the process in which the cooling power of the compressor 21 varies.

For ease of description, hereinafter the reference operation rate r may be assumed to be 0.5. When the reference operation rate is 0.5, the on time and the off time of the compressor may be equal to each other, and thus the reference value may be 1.

When the slope ratio is equal to the reference value (for example, when the on slope is equal to the off slope), the controller 50 may determine to maintain the cooling power of the compressor 21.

On the other hand, when the slope ratio is larger than the reference value (for example, when the on slope is larger than the off slope), the controller 50 may determine to reduce the cooling power of the compressor 21 to be less than the previous cooling power (i.e., less than during the previous time period).

Additionally, when the slope ratio is less than (or smaller than) the reference value (for example, when the on slope is less than the off slope), the controller 50 may determine to increase the cooling power of the compressor 21 to be more than the previous cooling power (i.e., more than during the previous time period).

An example in which the on slope is larger than the off slope is an example in which the temperature drop rate of the storage compartment is fast when the compressor 21 operates. In this example, the controller 50 may determine that the cooling power of the compressor 21 is higher than the optimum cooling power, and determine to reduce the cooling power of the compressor 21.

When the on slope is less than (or smaller than) the off slope, then the temperature drop rate of the storage compartment may be slow when the compressor 21 operates. In this example, the controller 50 may determine that the cooling power of the compressor 21 is lower than the optimum cooling power, and may determine to increase the cooling power of the compressor 21.

As one non-limiting example, when it is necessary to increase the cooling power of the compressor 21, the controller 50 may increase the cooling power by (1+n) times as compared with the previous cooling power.

On the other hand, when it is necessary to reduce the cooling power of the compressor 21, the controller 50 may reduce the cooling power by (1−n) times, where n is a value larger than 0 and smaller than 1.

For ease of description, n may be assumed to be 0.5.

When the cooling power of the compressor 21 is increased, the cooling power of the compressor 21 may be increased to 1.5 times (150%) of the previous cooling power, for example. When the cooling power of the compressor 21 is reduced, the cooling power of the compressor 21 may be reduced to 0.5 times (50%) of the previous cooling power, for example.

Referring to FIG. 3, the compressor 21 may operate with a maximum cooling power (100%) and may be turned off at the time T1. The compressor 21 may be turned on again at the time T2 when the compressor 21 is in a turned off state.

At this time, since the on slope until the time T1 is larger than the off slope for the time T2-T1, the controller 50 may determine to reduce the cooling power of the compressor 21. Therefore, the compressor 21 may operate with 50% of the previous cooling power of the compressor 21, for example.

Additionally, after the compressor 21 is turned on, the compressor 21 may be turned off at the time T3. The compressor 21 may be turned on again at the time T4 when the compressor 21 is in a turned off state.

At this time, since the on slope for the time T3-T2 is larger than the off slope for the time T4-T3, the controller 50 may determine to reduce the cooling power of the compressor 21 again. Therefore, the compressor 21 may operate with 50% of the previous cooling power of the compressor 21 (i.e., at 25% of the maximum cooling power), for example.

The slope ratio may approach a reference value by varying the cooling power of the compressor 21. The compressor 21 may operate with the optimum cooling power of the compressor 21 (which is lower than the maximum cooling power), and the optimum cooling power may be maintained, thereby reducing power consumption of the compressor 21.

The on slope and the off slope may be variable according to temperature around the refrigerator. In the present disclosure, since the on slope and the off slope are obtained for each cycle of the cooling cycle (i.e., one compressor on time and one compressor off time) and are compared with the reference values, it may be unnecessary to set the cooling power for each outdoor temperature before the product is sold.

In the present disclosure, the value of n may be variable.

For example, the door may be opened to increase the temperature of the storage compartment, or the temperature of the storage compartment may be increased during defrosting operation of the evaporator. In this state, it may be necessary to quickly lower the temperature of the storage compartment. A state in which it is necessary to quickly reduce the temperature of the storage compartment may be referred to as a load correspondence state.

In the present example embodiment, since the cooling power is increased by (1+n) times as compared with the previous cooling power, the increase in the cooling power may be limited. In this example, the temperature drop rate of the storage compartment may also be limited.

Therefore, in the load correspondence state, the value of n may be increased. When the value of n is increased, the increase in the cooling power may be large, and thus the temperature drop rate of the storage compartment may be increased.

Figure 4:
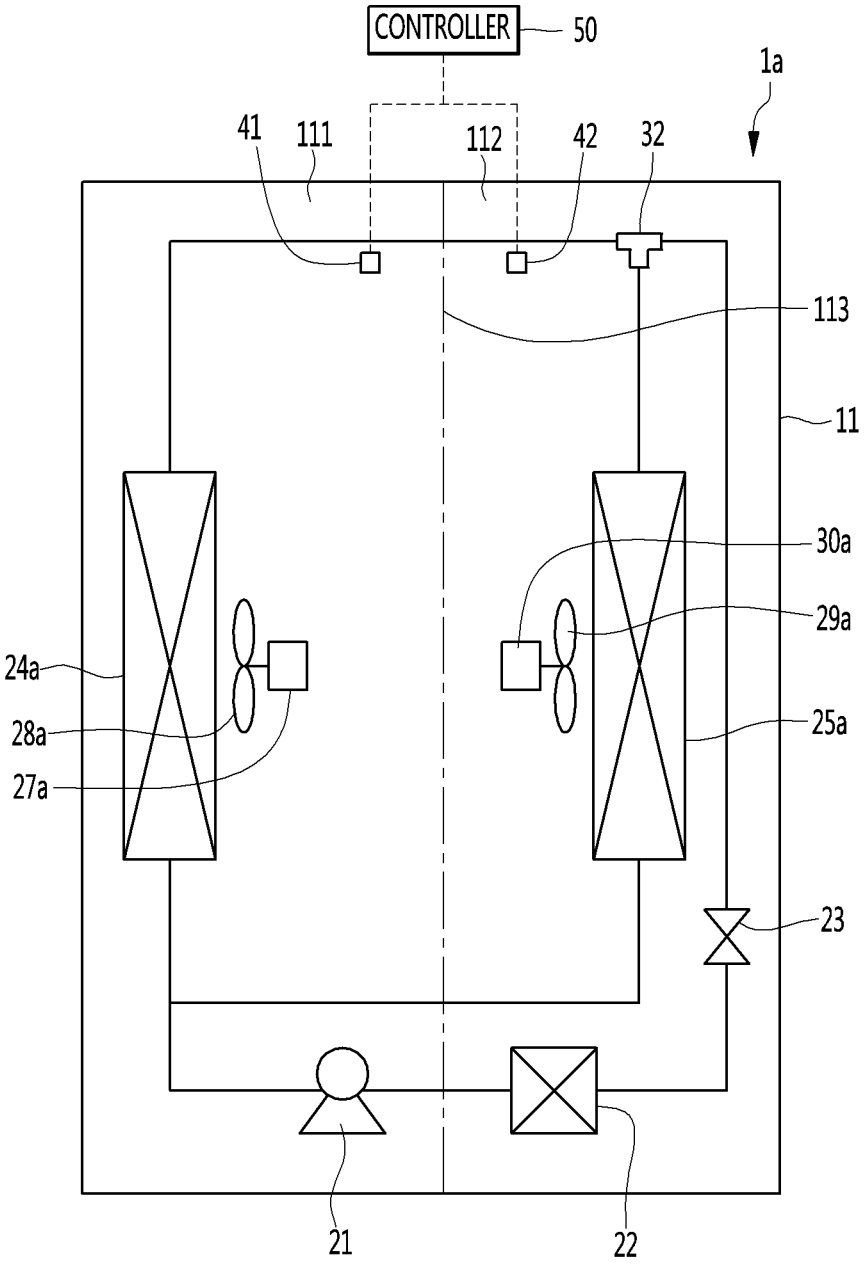
FIG. 4 is a view schematically showing a configuration of a refrigerator according to an example embodiment of the present disclosure.
Figure 5:
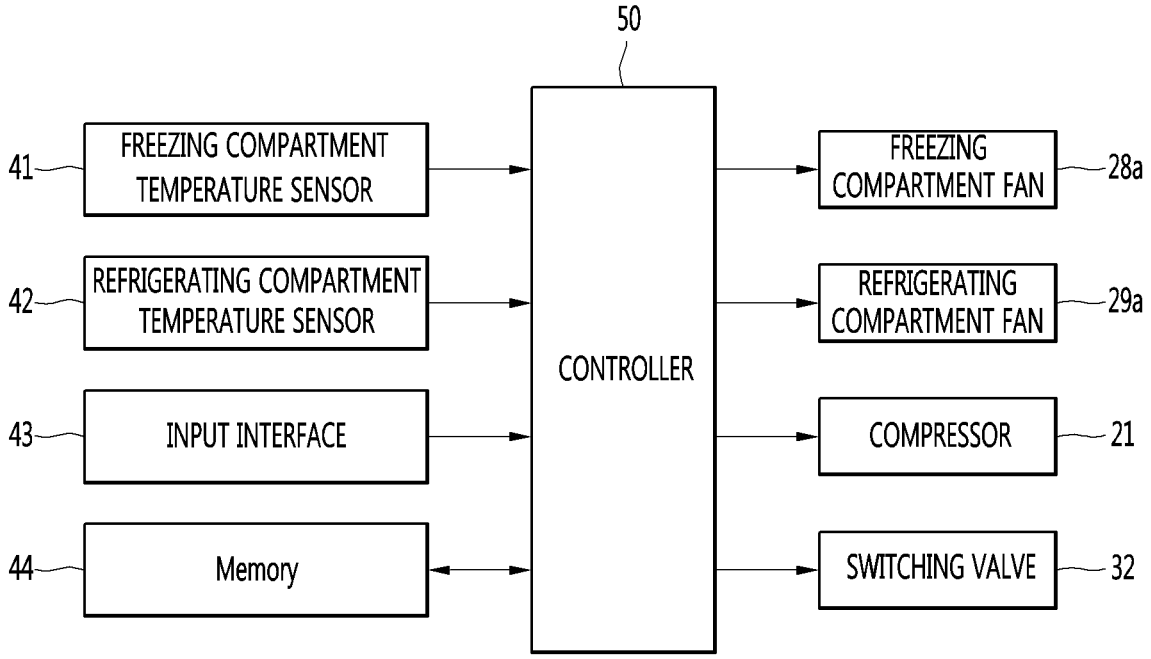
FIG. 5 is a block diagram of a refrigerator according to an example embodiment of the present disclosure.

FIG. 4 is a view schematically showing a configuration of a refrigerator according to an example embodiment of the present disclosure. FIG. 5 is a block diagram of a refrigerator according to an example embodiment of the present disclosure. Other embodiments and configurations may also be provided.

In the description of an example embodiment, the same reference numerals may be assigned to refer to the same components as those of the foregoing embodiment(s).

Referring to FIGS. 4 and 5, a refrigerator 1*a* according to an example embodiment may include the cabinet 11 having the freezing compartment 111 and the refrigerating compartment 112 therein and a door coupled to the cabinet 11 to open and close each of the freezing compartment 111 and the refrigerating compartment 112.

The freezing compartment 111 and the refrigerating compartment 112 may be horizontally or vertically partitioned within the cabinet 11 by the partitioning wall 113.

The refrigerator 1*a* may include the compressor 21, the condenser 22, the expansion member 23, a first evaporator 24*a* for a freezing compartment to generate cold air for cooling the freezing compartment 111, and a second evaporator 25*a* for a refrigerating compartment to generate cold air for cooling the refrigerating compartment 112.

The refrigerator 1*a* may include a switching valve 32 (or switch) for allowing the refrigerant passing through the expansion member 23 to flow to one of the first evaporator 24*a* (for the freezing compartment) and/or the second evaporator 25*a* (for the refrigerating compartment).

In the present disclosure, a second state of the switching valve 32 may be the state in which the switching valve 32 operates so that the refrigerant flows to the first evaporator 24*a* (for the freezing compartment). The first state of the switching valve 32 may be a state in which the switching valve 32 operates so that the refrigerant flows to the second evaporator 25*a* (for the refrigerating compartment). The switching valve 32 may be a three way valve, for example.

The switching valve 32 may selectively open one of a first refrigerant passage connected between the compressor 21 and the second evaporator 25*a* to allow the refrigerant to flow therebetween and a second refrigerant passage connected between the compressor 21 and the first evaporator 24*a* to allow the refrigerant to flow therebetween. The cooling of the refrigerating compartment 112 and the cooling of the freezing compartment 111 may alternately operate based on the switching valve 32.

Since the switching valve 32 functions as a freezing compartment valve and a refrigerating compartment valve, a first state of the switching valve 32 may be a state in which the freezing compartment valve is turned off and the refrigerating compartment valve is turned on.

Additionally, a state of the switching valve 32 may be a state in which the freezing compartment valve is turned on and the refrigerating compartment valve is turned off. Depending on a situation, the freezing compartment valve and the refrigerating compartment valve may be turned on at the same time.

The refrigerator 1*a* may include a freezing compartment fan 28*a* (or a first fan) for blowing air to the first evaporator 24*a* (for the freezing compartment), a first motor 27*a* for rotating the freezing compartment fan 28*a*, a refrigerating compartment fan 29*a* (or a second fan) for blowing air to the second evaporator 25*a* (for the refrigerating compartment), and a second motor 30*a* for rotating the refrigerating compartment fan 29*a*.

In the present example embodiment, a "freezing cycle" may be a series of cycles in which the refrigerant flows to the compressor 21, the condenser 22, the expansion member 23, and the first evaporator 24*a* (for the freezing compartment. The "refrigerating cycle" may be a series of cycles in which the refrigerant flows to the compressor 21, the condenser 22, the expansion member 23, and the second evaporator 25*a* (for the refrigerating compartment).

The terminology that "the refrigerating cycle is operated" (or the refrigerating cycle is operating) may mean that the compressor 21 is turned on, the refrigerating compartment fan 29*a* is rotating, and while the refrigerant flows in the second evaporator 25*a* (for the refrigerating compartment) by the switching valve 32, the refrigerant flowing in the second evaporator 25*a* (for the refrigerating compartment) is heat-exchanged with air.

Further, the terminology that "the freezing cycle is operated" (or the freezing cycle is operating) may mean that the compressor 21 is turned on, the freezing compartment fan 28*a* is rotating, and while the refrigerant flows in the first evaporator 24*a* (for the freezing compartment) by the switching valve 32, the refrigerant flowing in the first evaporator 24*a* (for the freezing compartment) is heat-exchanged with air.

Although one expansion member 23 is disposed at an upstream side of the switching valve 32 as described above, a first expansion member may be disposed between the switching valve 32 and the first evaporator 24*a* (for the freezing compartment), and a second expansion member may be disposed between the switching valve 32 and the second evaporator 25*a* (for the refrigerating compartment).

As another example, a second valve (or freezing compartment valve) may be disposed at an inlet side of the first evaporator 24*a* (for the freezing compartment), and a first valve (or refrigerating compartment valve) may be disposed at an inlet side of the second evaporator 25*a* (for the refrigerating compartment) without using the switching valve 32. Additionally, while the freezing cycle operates, the second valve may be turned on, and the first valve may be turned off. When the refrigerating cycle operates, the second valve may be turned off, and the first valve may be turned on.

In at least one example embodiment, the refrigerating compartment may be referred to as a first storage compartment, and the freezing compartment may be referred to as a second storage compartment. In at least one example embodiment, the refrigerating cycle may be referred to as a first cooling cycle for the first storage compartment, and the freezing cycle may be referred to as a second cooling cycle for the second storage compartment.

Alternatively, the refrigerating compartment may be referred to as the second storage compartment, and the freezing compartment may be referred to as the first storage compartment. In at least one example embodiment, the refrigerating cycle may be referred to as the second cooling cycle for the second storage compartment, and the freezing cycle may be referred to as the first cooling cycle for the first storage compartment.

The refrigerator 1*a* may include the freezing compartment temperature sensor 41 for sensing a temperature of the freezing compartment 111, the refrigerating compartment temperature sensor 42 for sensing a temperature of the refrigerating compartment 112, an input interface 43 for inputting a set temperature (or a target temperature) of each of the freezing compartment 111 and the refrigerating compartment 112, and the controller 50 for controlling the cooling cycle (including the freezing cycle and the refrigerating cycle) based on the inputted target temperature and the temperatures sensed by the temperature sensors 41 and 42.

Additionally, in at least one example embodiment, a temperature lower than the set temperature of the refrigerating compartment 112 may be referred to as a first refrigerating compartment reference temperature, and a temperature higher than the set temperature of the refrigerating compartment 112 may be referred to as a second refrigerating compartment reference temperature. Additionally, a range between the first refrigerating compartment reference temperature and the second refrigerating compartment reference temperature may be referred to as a range of the set temperature of the refrigerating compartment.

In at least one non-limiting example, the set temperature of the refrigerating compartment 112 may be a mean temperature of the first refrigerating compartment reference temperature and the second refrigerating compartment reference temperature.

In at least one example embodiment, a temperature lower than the set temperature of the freezing compartment 111 may be called a first freezing compartment reference temperature, and a temperature higher than the set temperature of the freezing compartment 111 may be called a second freezing compartment reference temperature. A range between the first freezing compartment reference temperature and the second freezing compartment reference temperature may be called a freezing compartment set temperature range.

In at least one non-limited example, the set temperature of the freezing compartment 111 may be a mean temperature of the first freezing compartment reference temperature and the second freezing compartment reference temperature.

In at least one non-limiting example embodiment, a user may set a target temperature of each of the freezing compartment 111 and the refrigerating compartment 112.

In at least one non-limiting example embodiment, the controller 50 may control the refrigerating cycle, the freezing cycle, and a pump down operation to provide one operation cycle. That is, the controller 50 may start the cycle while continuously operating the compressor 21 without stopping the compressor 21.

In at least one non-limiting example embodiment, the pump down operation may refer to an operation of collecting the refrigerant remaining in each evaporator into the compressor 21 by operating the compressor 21 while supplying of the refrigerant to all of the plurality of evaporators is blocked (i.e. the refrigerant is not provided to the evaporators).

The controller 50 may control operation of the refrigerating cycle. Further, when a stop condition of the refrigerating cycle is satisfied, the controller 50 may operate the freezing cycle.

When a stop condition of the freezing cycle is satisfied while the freezing cycle is operating, the pump down operation may be performed. When the pump down operation is completed, the refrigerating cycle may operate again.

In an example embodiment, the example in which the stop condition of the refrigerating cycle is satisfied may be referred to as an example in which the cooling of the refrigerating compartment is completed.

Additionally, the example in which the stop condition of the freezing cycle is satisfied may be referred to as an example in which the cooling of the freezing compartment is completed.

In the present example embodiment, the stop condition of the refrigerating cycle may be the same as a start condition of the freezing cycle.

In the present example embodiment, the pump down operation may be omitted under special conditions. In this example, the refrigerating cycle and the freezing cycle may operate alternately. In this connection, the refrigerating cycle and the freezing cycle may form one operation cycle.

In an example, when a temperature of outside air is low, then the pump down operation may be omitted.

The refrigerator 1*a* may include a memory 44 to store the operation rate of the refrigerating compartment valve and to store the operation rate of the freezing compartment valve.

A control method of the refrigerator of an example embodiment may be described.

Figure 6:
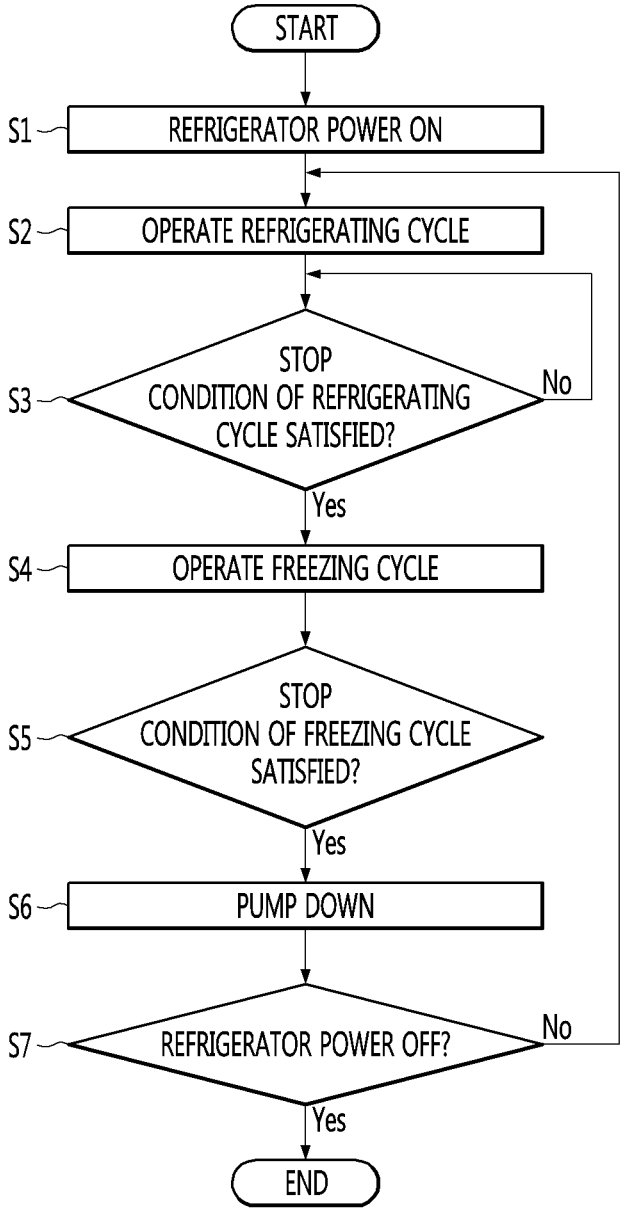
FIG. 6 is a flowchart for schematically describing a control method of a refrigerator according to an example embodiment of the present disclosure.
Figure 7:
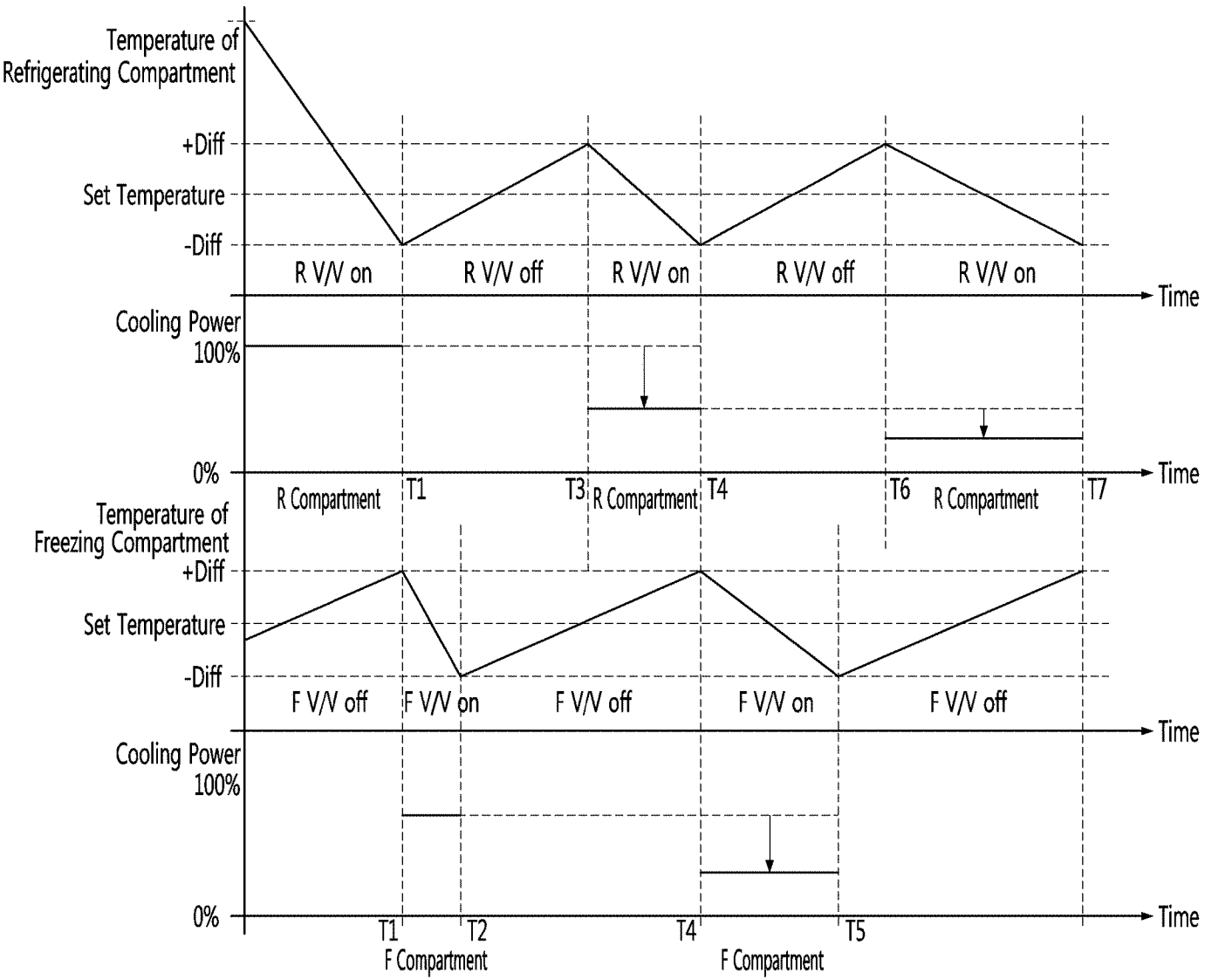
FIG. 7 is a view for describing a change in cooling power of a compressor according to a temperature change of a refrigerating compartment and a freezing compartment according to an example embodiment of the present disclosure.

FIG. 6 is a flowchart for schematically describing a control method of a refrigerator according to an example embodiment of the present disclosure. FIG. 7 is a view for describing a change in cooling power of a compressor according to a temperature change of a refrigerating compartment and a freezing compartment according to an embodiment of the present disclosure. Other embodiments, operations and orders of operations may also be provided.

Referring to FIGS. 4 to 7, the power of the refrigerator 1 is turned on (S1). When the power of the refrigerator 1 is turned on, the refrigerator 1 may operate to cool the freezing compartment 111 and/or the refrigerating compartment 112.

The control method (of the refrigerator) when the refrigerating compartment 112 is first cooled and the freezing compartment 111 is then cooled will be described.

In order to cool the refrigerating compartment 112, the controller 50 may operate the refrigerating cycle (S2).

For example, the controller 50 may control the compressor 21 to turn on and rotate the refrigerating compartment fan 29*a*. The switching valve 32 may be switched to the first state such that refrigerant flows into the second evaporator 25*a* for the refrigerating compartment (or the freezing compartment valve is turned off and the refrigerating compartment valve is turned on).

The freezing compartment fan 28*a* may remain in a stopped state when the refrigerating cycle is in operation.

The refrigerant compressed by the compressor 21 and that passes through the condenser 22 may flow into the second evaporator 25*a* (for the refrigerating compartment) through the switching valve 32. The refrigerant evaporated while flowing through the second evaporator 25*a* (for the refrigerating compartment) may flow back into the compressor 21.

Air heat-exchanged with the second evaporator 25*a* (for the refrigerating compartment) is supplied to the refrigerating compartment 112. Therefore, the temperature of the refrigerating compartment 112 may be lowered, while the temperature of the freezing compartment 111 is increased.

The controller 50 may determine whether the stop condition of the refrigerating cycle is satisfied during the operation of the refrigerating cycle (S3). That is, the controller 50 determines whether the start condition of the refrigerating cycle is satisfied.

For example, the controller 50 may determine that the stop condition of the refrigerating cycle is satisfied when the temperature of the refrigerating compartment 112 reaches a value equal to or less than the first refrigerating compartment reference temperature.

When it is determined in operation S3 that the stop condition of the refrigerating cycle is satisfied (i.e., yes), then the controller 50 may operate the refrigerating cycle (S4).

For example, the controller 50 may switch (or changes) the switching valve 32 to the second state (or turn on the freezing compartment valve and turn off the refrigerating compartment valve) such that the refrigerant flows into the first evaporator 24*a* (for the freezing compartment). Even when the refrigerating cycle is switched to the freezing cycle, the compressor 21 may continue to operate without stopping.

The controller 50 may rotate the freezing compartment fan 28*a* and stop the refrigerating compartment fan 29*a*.

The controller 50 may determine whether the stop condition of the freezing cycle is satisfied during the operation of the refrigerating cycle (S5).

For example, the controller 50 may determine that the stop condition of the refrigerating cycle is satisfied when the temperature of the freezing compartment 111 reaches a value equal to or less than the first freezing compartment reference temperature.

At this time, when the temperature of the refrigerating compartment 112 reaches a value equal to or greater than the second refrigerating compartment reference temperature before the temperature of the freezing compartment 111 reaches a value equal to or less than the first freezing compartment reference temperature, the controller 50 may determine that the stop condition of the refrigerating cycle is satisfied.

When the refrigerating cycle is stopped, the pump down operation may be performed (S6). In the pump down operation, the freezing compartment valve and the refrigerating compartment valve are turned off. That is, the switching valve 32 is in the third state such that the refrigerant does not flow into either of the first and second evaporators.

As long as the power of the refrigerator 1 is not turned off (S7), the controller 50 operates the refrigerating cycle again.

In the present example embodiment, the freezing compartment valve and the refrigerating compartment valve may be repeatedly turned on and off while the refrigerating cycle and the refrigerating cycle are repeatedly performed.

In the present disclosure, the ratio of the on time of the refrigerating compartment valve to the sum of the on time and the off time of the refrigerating compartment valve may be referred to as an operation rate of the refrigerating compartment valve (i.e., a first operation rate).

Additionally, in the present disclosure, the ratio of the on time of the freezing compartment valve to the sum of the on time and the off time of the freezing compartment valve may be referred to as an operation rate of the freezing compartment valve (i.e., a second operation rate).

The reference operation rate of the refrigerating compartment valve and the reference operation rate of the freezing compartment valve may be predetermined and stored in the memory 44.

The reference operation rate of the refrigerating compartment valve and the reference operation rate of the freezing compartment valve may be fixed values or may be variable.

The controller 50 may obtain temperature change information of the refrigerating compartment 112 during one operation period, compare the obtained temperature change information with the operation rate of the refrigerating compartment valve, and determine the cooling power of the compressor 21 to be operated in the next refrigerating cycle.

For example, the controller 50 may obtain a temperature change slope of the refrigerating compartment 112 during the time when the refrigerating compartment valve is turned on (hereinafter referred to as an on slope of the refrigerating compartment).

Additionally, the controller 50 may obtain a temperature change slope of the refrigerating compartment 112 during the time when the refrigerating compartment valve is turned off (hereinafter referred to as an off slope of the refrigerating compartment).

The controller 50 may obtain a ratio of the on slope of the refrigerating compartment to the off slope of the refrigerating compartment (the on slope/the off slope) (hereinafter referred to as a slope ratio of the refrigerating compartment).

The controller 50 may determine the cooling power of the compressor 21 in the next refrigerating cycle by using the slope ratio of the refrigerating compartment 112 and the reference operation rate of the refrigerating compartment 112 (hereinafter referred to as "r1").

For example, the controller 50 may determine the cooling power of the compressor 21 by comparing the slope ratio of the refrigerating compartment with the first reference value (r1/(1−r1)).

The cooling power of the compressor 21 in the next refrigerating cycle may be equal to the cooling power in the previous refrigerating cycle or may be variable, and the cooling power of the compressor 21 may be equal to or close to the optimum cooling power through the process in which the cooling power of the compressor 21 varies.

For ease of description, hereinafter the reference operation rate r1 of the refrigerating compartment is assumed to be 0.5.

When the reference operation rate of the refrigerating compartment is 0.5, the on time of the refrigerating compartment valve and the off time of the refrigerating compartment valve are equal to each other, and the first reference value will be 1.

When the slope ratio of the refrigerating compartment is equal to the first reference value (for example, when the on slope is equal to the off slope), the controller 50 may determine to maintain the cooling power of the compressor 21.

On the other hand, when the slope ratio of the refrigerating compartment is greater than (or larger than) the first reference value (for example, when the on slope is larger than the off slope), the controller 50 may determine to reduce the cooling power of the compressor 21 to be less than the previous cooling power (i.e., less than during the previous time period).

Additionally, when the slope ratio of the refrigerating compartment is less than (or smaller than) the first reference value (for example, when the on slope is less than the off slope), the controller 50 may determine to increase the cooling power of the compressor 21 to be more than the previous cooling power (i.e., more than during the previous time period).

An example in which the on slope of the refrigerating compartment is larger than the off slope of the refrigerating compartment is an example in which the temperature drop rate of the refrigerating compartment 112 is fast when the compressor 21 operates. In this example, the controller 50 may determine that the cooling power of the compressor 21 is higher than the optimum cooling power, and determine to reduce the cooling power of the compressor 21.

An example in which the on slope of the refrigerating compartment is less than (or smaller than) the off slope of the refrigerating compartment is an example in which the temperature drop rate of the refrigerating compartment 112 is slow when the compressor 21 operates. In this example, the controller 50 may determine that the cooling power of the compressor 21 is lower than the optimum cooling power, and the controller may determine to increase the cooling power of the compressor 21.

In at least one non-limiting example, when it is necessary to increase the cooling power of the compressor 21, the controller 50 may increase the cooling power by 1+n times as compared with the previous cooling power.

On the other hand, when it is necessary to reduce the cooling power of the compressor 21, the controller 50 may increase the cooling power by 1−n times.

For ease of description, n is assumed to be 0.5.

When the cooling power of the compressor 21 is increased, the cooling power of the compressor 21 may be increased to 150% of the previous cooling power, for example. When the cooling power of the compressor 21 is reduced, the cooling power of the compressor 21 may be reduced to 50% of the previous cooling power, for example.

Referring to FIG. 7, when the refrigerating cycle is operating, the compressor 21 may operate with a maximum cooling power (100%) and the refrigerating compartment valve may be turned off at the time T1. The refrigerating compartment valve may be turned on again at the time T3 in a state in which the refrigerating compartment valve is turned off.

At this time, since the on slope of the refrigerating compartment until the time T1 is larger than the off slope of the refrigerating compartment for the time T3-T1, the controller 50 may determine to reduce the cooling power of the compressor 21.

Therefore, the compressor 21 may operate with 50% of the previous cooling power for the time T4-T3.

Additionally, the refrigerating compartment valve may be turned off at the time T4, and may be turned on again at the time T6.

At this time, since the on slope of the refrigerating compartment for the time T4-T3 is larger than the off slope of the refrigerating compartment for the time T6-T4, the controller 50 may determine to reduce the cooling power of the compressor 21 again.

Therefore, the compressor 21 may operated with 50% of the previous cooling power (25% of the maximum cooling power) for the time T7-T6.

The slope ratio of the refrigerating compartment may approach a reference value by varying the cooling power of the compressor 21. In the refrigerating cycle operation period, the compressor 21 is operated with the optimum cooling power of the compressor 21 (which is lower than the maximum cooling power), and the optimum cooling power may be maintained, thereby reducing power consumption of the compressor 21.

Meanwhile, the controller 50 may obtain temperature change information of the freezing compartment 111 during one operation period, compare the obtained temperature change information with the operation rate of the freezing compartment valve, and determine the cooling power of the compressor 21 to be operated in the next freezing cycle.

For example, the controller 50 may obtain a temperature change slope of the freezing compartment 111 during the time when the freezing compartment valve is turned on (hereinafter referred to as an on slope of the freezing compartment).

Additionally, the controller 50 may obtain a temperature change slope of the freezing compartment 111 during the time when the freezing compartment valve is turned off (hereinafter referred to as an off slope of the freezing compartment).

The controller 50 may obtain a ratio of the on slope of the freezing compartment to the off slope of the freezing compartment (the on slope/the off slope) (hereinafter referred to as a slope ratio of the freezing compartment).

The controller 50 may determine the cooling power of the compressor 21 in the next freezing cycle by using the slope ratio of the freezing compartment 111 and the reference operation rate of the freezing compartment 111 (hereinafter referred to as "r2").

For example, the controller 50 may determine the cooling power of the compressor 21 by comparing the slope ratio of the freezing compartment with the second reference value (r2/(1−r2)).

The cooling power of the compressor 21 in the next freezing cycle may be equal to the cooling power in the previous freezing cycle or may be variable, and the cooling power of the compressor 21 may be the equal to or close to the optimum cooling power through the process in which the cooling power of the compressor 21 varies.

For ease of description, hereinafter the reference operation rate r2 of the freezing compartment is assumed to be 0.5.

When the reference operation rate of the freezing compartment is 0.5, the on time of the freezing compartment valve and the off time of the freezing compartment valve are equal to each other, and the second reference value will be 1.

When the slope ratio of the freezing compartment is equal to the second reference value (for example, when the on slope is equal to the off slope), the controller 50 may determine to maintain the cooling power of the compressor 21.

On the other hand, when the slope ratio of the freezing compartment is larger than the second reference value (for example, when the on slope is larger than the off slope), the controller 50 may determine to reduce the cooling power of the compressor 21 to be less than the previous cooling power.

Additionally, when the slope ratio of the freezing compartment is less than (or smaller than) the second reference value (for example, when the on slope is smaller than the off slope), the controller 50 may determine to increase the cooling power of the compressor 21 to be more than the previous cooling power.

An example in which the on slope of the freezing compartment is larger than the off slope of the freezing compartment is an example in which the temperature drop rate of the freezing compartment 111 is fast when the compressor 21 operates. In this example, the controller 50 may determine that the cooling power of the compressor 21 is higher than the optimum cooling power, and determine to reduce the cooling power of the compressor 21.

An example in which the on slope of the freezing compartment is larger than the off slope of the freezing compartment is an example in which the temperature drop rate of the freezing compartment 111 is slow when the compressor 21 operates. In this example, the controller 50 may determine that the cooling power of the compressor 21 is less than (or lower than) the optimum cooling power, and determine to increase the cooling power of the compressor 21.

Although not limited, when it is necessary to increase the cooling power of the compressor 21, the controller 50 may increase the cooling power by 1+n times as compared with the previous cooling power.

Meanwhile, when it is necessary to increase the cooling power of the compressor 21, the controller 50 may increase the cooling power by 1−n times.

For ease of description, n is assumed to be 0.5.

When the cooling power of the compressor 21 is increased, the cooling power of the compressor 21 may be increased to 150% of the previous cooling power, for example. When the cooling power of the compressor 21 is reduced, the cooling power of the compressor 21 may be reduced to 50% of the previous cooling power.

Referring to FIG. 7, when the refrigerating cycle is operating (time T1), the compressor 21 is operated with a predetermined cooling power and the freezing compartment valve is turned on. At the time T2, the freezing compartment valve may be turned off.

The freezing compartment valve may be turned on again at the time T4 in a state in which the freezing compartment valve is turned off.

At this time, since the on slope of the freezing compartment for the time T3-T1 is larger than the off slope of the freezing compartment for the time T4-T2, the controller 50 may determine to reduce the cooling power of the compressor 21.

Therefore, the compressor 21 may operate with 50% of the previous cooling power for the time T5-T4, for example.

In the present embodiment, the value of n may be variable.

For example, the door may be opened to increase the temperature of the storage compartment, or the temperature of the storage compartment may be increased during the defrosting operation of the evaporator. In this state, it may be necessary to quickly lower the temperature of the storage compartment. A state in which it is necessary to quickly reduce the temperature of the storage compartment may be referred to as a load corresponding state.

In the present example embodiment, since the cooling power is increased by 1+n times as compared with the previous cooling power, the increase in the cooling power may be limited. In this example, the temperature drop rate of the storage compartment is also limited.

Therefore, in the load corresponding state, the value of n may be increased. When the value of n is increased, the increase in the cooling power is large, and thus the temperature drop rate of the storage compartment may be increased.

Meanwhile, in the present example embodiment, when the reference operation rate is high, the on time of the compressor or the on time of the freezing compartment valve or the refrigerating compartment valve is increased.

As such, when the reference operation rate is high, the refrigerator humidity in the storage compartment may be lowered.

Therefore, when it is necessary to control the humidity of the storage compartment, the reference operation rate may vary according to the humidity of the storage compartment.

Additionally, in the example of a refrigerator using two evaporators, since the freezing compartment does not have a large influence on the change in the state of food according to the change in humidity, the reference operation rate of the freezing compartment may be fixed.

On the other hand, in the example of the refrigerating chamber, since the state of food is largely changed according to the humidity, the reference operation rate of the refrigerating compartment may be changed.

Embodiments may provide a refrigerator, which do not need to previously set a cooling power according to outdoor temperature for each product because the cooling power of the compressor is variable in the actual use process of the refrigerator, and method for controlling the same.

Embodiments may provide a refrigerator, which prevents a compressor from operating with a cooling power higher than a required cooling power, and a control method for controlling the same.

Embodiments may provide a refrigerator capable of controlling humidity of a storage compartment and a method for controlling the same.

In one embodiment, a method for controlling a refrigerator may include: turning on a compressor to operate with a predetermined cooling power for cooling a storage compartment; turning off the compressor when a temperature of the storage compartment reaches a temperature equal to or lower than a first reference temperature; and turning on the compressor again when the temperature of the storage compartment reaches a temperature equal to or higher than a second reference temperature higher than the first reference temperature.

In the turning on the compressor again, the compressor may be operated with a cooling power determined based on an on slope, which is a temperature change slope of the storage compartment during an on time of the compressor, and an off slope, which is a temperature change slope of the storage compartment during an off time of the compressor.

The cooling power of the compressor may be determined according to a result of comparing a ratio of the on slope to the off slope with a predetermined reference value.

When the ratio of the on slope to the off slope is equal to the reference value, the cooling power of the compressor may be maintained to be equal to the predetermined cooling power. When the ratio of the on slope to the off slope is larger than the reference value, the cooling power of the compressor may be more reduced than the predetermined cooling power. When the ratio of the on slope to the off slope is smaller than the reference value, the cooling power of the compressor may be more increased than the predetermined cooling power.

A ratio of the on time of the compressor to the sum of the on time and the off time of the compressor may be an operation rate. The reference value may be defined as: operation rate/(1−(operation rate)).

The operation rate may be a predetermined value and may be a fixed value.

When the ratio of the on slope to the off slope is larger than the reference value, the cooling power of the compressor may be reduced to 1−n times of the predetermined cooling power.

When the ratio of the on slope to the off slope is smaller than the reference value, the cooling power of the compressor may be increased to 1+n times of the predetermined cooling power. n may be a value larger than 0 and smaller than 1. n may be variable. n may be increased after an opening of a door is detected or after a defrosting operation is performed.

In one embodiment, there is provided a method for controlling a refrigerator, the refrigerator including a compressor configured to compress a refrigerant, a first evaporator configured to receive the refrigerant from the compressor to generate cold air for cooling a first storage compartment, a first fan configured to supply the cold air to the first storage compartment, a second evaporator configured to receive the refrigerant from the compressor to generate cold air for cooling a second storage compartment, a second fan configured to supply the cold air to the second storage compartment, a first valve configured to open or close a first refrigerant passage connected between the compressor and the first evaporator to allow the refrigerant to flow therebetween, and a second valve configured to open or close a second refrigerant passage connected between the compressor and the second evaporator to allow the refrigerant to flow therebetween, wherein the cooling of the first storage compartment and the cooling of the second compartment alternately operate.

The method may include operating a first cooling cycle for cooling the first storage compartment, such that the compressor is operated, the first valve is turned on, and the second valve is turned off, and when a stop condition of the first cooling cycle is satisfied, turning off the first valve and switching to a second cooling cycle for cooling the second storage compartment, such that the compressor is operated and the second valve is turned on.

The cooling power of the compressor in a next first cooling cycle may be determined based on an on slope of the first storage compartment, which is a temperature change slope of the first storage compartment during an on time of the first valve, and an off slope of the first storage compartment, which is a temperature change slope of the first storage compartment during an off time of the first valve, in a previous first cooling cycle.

The cooling power of the compressor in a next second cooling cycle may be determined based on an on slope of the second storage compartment, which is a temperature change slope of the second storage compartment during an on time of the second valve, and an off slope of the second storage compartment, which is a temperature change slope of the second storage compartment during an off time of the second valve, in a previous second cooling cycle.

The cooling power of the compressor in the next first cooling cycle may be determined according to a result of comparing a ratio of the on slope of the first storage compartment and the off slope of the first storage compartment with a predetermined first reference value.

The cooling power of the compressor in the next second cooling cycle may be determined according to a result of comparing a ratio of the on slope of the second storage compartment and the off slope of the second storage compartment with a predetermined second reference value When the ratio of the on slope of the first storage compartment to the off slope of the first storage compartment is equal to the first reference value, the cooling power of the compressor may be maintained to be equal to the predetermined cooling power.

When the ratio of the on slope of the first storage compartment to the off slope of the first storage compartment is larger than the first reference value, the cooling power of the compressor may be more reduced than the predetermined cooling power.

When the ratio of the on slope of the first storage compartment to the off slope of the first storage compartment is smaller than the first reference value, the cooling power of the compressor may be more increased than the predetermined cooling power.

When the ratio of the on slope of the second storage compartment to the off slope of the second storage compartment is equal to the second reference value, the cooling power of the compressor may be maintained to be equal to the predetermined cooling power.

When the ratio of the on slope of the second storage compartment to the off slope of the second storage compartment is larger than the second reference value, the cooling power of the compressor may be more reduced than the predetermined cooling power.

When the ratio of the on slope of the second storage compartment to the off slope of the second storage compartment is smaller than the second reference value, the cooling power of the compressor may be more increased than the predetermined cooling power.

A ratio of the on time of the first valve to the sum of the on time and the off time of the first valve may be a first operation rate, and the first operation rate may be a predetermined operation rate.

The first reference value may be defined as: first operation rate/(1−(first operation rate)).

A ratio of the on time of the second valve to the sum of the on time and the off time of the second valve may be a second operation rate, and the second operation rate may be a predetermined operation rate.

The second reference value may be defined as: second operation rate/(1−(second operation rate)).

When the ratio of the on slope to the off slope of the each storage compartments is larger than the each reference value, the cooling power of the compressor may be reduced to 1−n times of the predetermined cooling power.

When the ratio of the on slope to the off slope of the each storage compartments is smaller than the each reference value, the cooling power of the compressor may be increased to 1+n times of the predetermined cooling power. n is a value larger than 0 and smaller than 1.

In one embodiment, a refrigerator may include: a compressor configured to cool a storage compartment; a temperature sensor configured to sense a temperature of the storage compartment; and a controller configured to control the compressor.

The controller may be configured to: operate the compressor with a predetermined cooling power for cooling the storage compartment; turn off the compressor when a temperature of the storage compartment reaches a temperature equal to or lower than a first reference temperature; and operate the compressor again with a re-determined cooling power when the temperature of the storage compartment reaches a temperature equal to or higher than a second reference temperature higher than the first reference temperature.

The re-determined cooling power may be determined based on an on slope, which is a temperature change slope of the storage compartment during an on time of the compressor, and an off slope, which is a temperature change slope of the storage compartment during an off time of the compressor.

In one embodiment, a refrigerator may include: a compressor configured to compress a refrigerant; a first evaporator configured to receive the refrigerant from the compressor to generate cold air for cooling a first storage compartment; a first temperature sensor configured to sense a temperature of the first storage compartment; a first fan configured to supply the cold air to the first storage compartment; a second evaporator configured to receive the refrigerant from the compressor to generate cold air for cooling a second storage compartment; a second temperature sensor configured to sense a temperature of the second storage compartment; a second fan configured to supply the cold air to the second storage compartment; a first valve configured to open or close a first refrigerant passage connected between the compressor and the first evaporator to allow the refrigerant to flow therebetween; a second valve configured to open or close a second refrigerant passage connected between the compressor and the second evaporator to allow the refrigerant to flow therebetween; and a controller configured to control the first valve, the second valve, and the compressor.

The controller may be configured to turn on the compressor and the first valve and turn off the second valve when a first cooling cycle for cooling the first storage compartment is operated. The controller may be configured to turn off the first valve when a stop condition of the first cooling cycle is satisfied, and operate the compressor and turn on the second valve in order to operate a second cooling cycle for cooling the second storage compartment. The controller may be configured to determine the cooling power of the compressor in a next first cooling cycle based on an on slope of the first storage compartment, which is a temperature change slope of the first storage compartment during an on time of the first valve, and an off slope of the first storage compartment, which is a temperature change slope of the first storage compartment during an off time of the first valve, in a previous first cooling cycle.

The controller may be configured to determine the cooling power of the compressor in a next second cooling cycle based on an on slope of the second storage compartment, which is a temperature change slope of the second storage compartment during an on time of the second valve, and an off slope of the second storage compartment, which is a temperature change slope of the second storage compartment during an off time of the second valve, in a previous second cooling cycle.

The details of one or more embodiments are set forth in the accompanying drawings and the description below. Other features will be apparent from the description and drawings, and from the claims.

The above description is merely illustrative of the technical idea of the present disclosure, and various modifications and changes may be made thereto by those skilled in the art without departing from the essential characteristics of the present disclosure.

Therefore, the embodiments of the present disclosure are not intended to limit the technical spirit of the present disclosure but to describe the technical idea of the present disclosure, and the technical spirit of the present disclosure is not limited by these embodiments.

The scope of protection of the present disclosure should be interpreted by the appending claims, and all technical ideas within the scope of equivalents should be construed as falling within the scope of the present disclosure.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method for controlling a refrigerator having a compressor and a storage compartment, comprising:

turning the compressor on to operate with a predetermined cooling power for cooling the storage compartment;

determining that a temperature of the storage compartment has decreased to a first reference temperature turning the compressor off when the temperature of the storage compartment is determined to have decreased to the first reference temperature;

determining that the temperature of the storage compartment has increased to a second reference temperature, the second reference temperature being higher than the first reference temperature, and turning the compressor on again when the temperature of the storage compartment is determined to have increased to the second reference temperature, wherein the turning of the compressor on again includes:

determining a cooling power for the compressor based on an on slope and an off slope, the on slope being a temperature change slope of the storage compartment during an on time of the compressor in which the compressor is turned on, and the off slope being a temperature change slope of the storage compartment during an off time of the compressor in which the compressor is turned off, and operating the compressor at the determined cooling power, wherein the cooling power of the compressor is determined based on a comparison of a predetermined reference value and a slope ratio of the on slope to the off slope.

2. The method of claim 1, wherein when the slope ratio is equal to the reference value, the cooling power of the compressor is determined to be maintained at the predetermined cooling power, wherein when the slope ratio is larger than the reference value, the cooling power of the compressor is determined to be reduced to be less than the predetermined cooling power, and wherein when the slope ratio is less than the reference value, the cooling power of the compressor is determined to be increased to be more than the predetermined cooling power.

3. The method of claim 2, wherein an operation rate is a ratio of the on time of the compressor to a sum of the on time of the compressor and the off time of the compressor, and wherein the reference value is defined as:

operation rate/(1−(operation rate)).

4. The method of claim 3, wherein the operation rate is a predetermined value and is a fixed value.

5. The method of claim 2, wherein when the slope ratio is larger than the reference value, the cooling power of the compressor is determined to be reduced to 1−n times of the predetermined cooling power, wherein when the slope ratio is less than the reference value, the cooling power of the compressor is determined to be increased to 1+n times of the predetermined cooling power, and wherein n is a value larger than 0 and is smaller than 1.

6. The method of claim 5, wherein n is variable.

7. The method of claim 6, wherein n is increased after an opening of a door is detected or after a defrosting operation of the refrigerator is performed.

8. A method for controlling a refrigerator, the refrigerator including a compressor configured to compress a refrigerant, a first evaporator configured to receive the refrigerant from the compressor to generate cold air for cooling a first storage compartment, a second evaporator configured to receive the refrigerant from the compressor to generate cold air for cooling a second storage compartment, a first valve configured to open or close a first refrigerant passage connected between the compressor and the first evaporator to allow the refrigerant to flow therebetween, and a second valve configured to open or close a second refrigerant passage connected between the compressor and the second evaporator to allow the refrigerant to flow therebetween, wherein the cooling of the first storage compartment and the cooling of the second compartment alternately operate, the method comprising:

performing a first cooling cycle for cooling the first storage compartment, such that the compressor is operated, the first valve is opened, and the second valve is closed;

determining that a stop condition of the first cooling cycle is satisfied; and when the stop condition of the first cooling cycle is determined to be satisfied, closing the first valve and changing to a second cooling cycle for cooling the second storage compartment, such that the compressor is operated and the second valve is opened, wherein the cooling power of the compressor in a next first cooling cycle is determined based on information from a previous first cooling cycle, wherein the cooling power for a cooling cycle is determined based on an on slope of the first storage compartment and an off slope of the first storage compartment, the on slope being a temperature change slope of the first storage compartment during an opening time of the first valve, and the off slope being a temperature change slope of the first storage compartment during a closing time of the first valve, wherein the cooling power of the compressor in the next first cooling cycle is determined based on a comparison of a predetermined first reference value and a first slope ratio of the on slope of the first storage compartment and the off slope of the first storage compartment.

9. The method of claim 8, wherein the cooling power of the compressor in a next second cooling cycle is determined based on information from a previous second cooling cycle, wherein the cooling power for a cooling cycle is determined based on an on slope of the second storage compartment and an off slope of the second storage compartment, the on slope being a temperature change slope of the second storage compartment during an opening time of the second valve, and the off slope being a temperature change slope of the second storage compartment during a closing time of the second valve.

10. The method of claim 9, wherein the cooling power of the compressor in the next second cooling cycle is determined based on a comparison of a predetermined second reference value and a second slope ratio of the on slope of the second storage compartment and the off slope of the second storage compartment.

11. The method of claim 10, wherein when the first slope ratio is equal to the first reference value, the cooling power of the compressor is determined to be maintained at the predetermined cooling power, wherein when the first slope ratio is larger than the first reference value, the cooling power of the compressor is determined to be reduced to be less than the predetermined cooling power, and wherein when the first slope ratio is less than the first reference value, the cooling power of the compressor is determined to be increased to be more than the predetermined cooling power.

12. The method of claim 10, wherein when the second slope ratio is equal to the second reference value, the cooling power of the compressor is determined to be maintained at the predetermined cooling power, wherein when the second slope ratio is larger than the second reference value, the cooling power of the compressor is determined to be reduced to be less than the predetermined cooling power, and wherein when the second slope ratio is less than the second reference value, the cooling power of the compressor is determined to be increased to be more than the predetermined cooling power.

13. The method of claim 12, wherein a first operation rate is a ratio of the opening time of the first valve to a sum of the opening time and the closing time of the first valve, wherein the first operation rate is a predetermined operation rate, and wherein the first reference value is defined as:

first operation rate/(1−(first operation rate)).

14. The method of claim 12, wherein a second operation rate is a ratio of the opening time of the second valve to a sum of the opening time and the closing time of the second valve, wherein the second operation rate is a predetermined operation rate, and wherein the second reference value is defined as:

second operation rate/(1−(second operation rate)).

15. The method of claim 12, wherein when the first slope ratio is larger than the first reference value, and the second slope ratio is larger than the second reference value, the cooling power of the compressor is determined to be reduced to 1−n times of the predetermined cooling power, wherein when the first slope ratio is less than the first reference value, and the second slope ratio is less than the second reference value, the cooling power of the compressor is determined to be increased to 1+n times of the predetermined cooling power, and wherein n is a value larger than 0 and smaller than 1.

16. A refrigerator comprising:

a compressor configured to cool a storage compartment;

a temperature sensor configured to sense a temperature of the storage compartment; and a controller configured to control the compressor, wherein the controller is configured to:

operate the compressor with a predetermined cooling power for cooling the storage compartment;

determine that a temperature of the storage compartment has decreased to a first reference temperature;

turn the compressor off when the temperature of the storage compartment is determined to have decreased to the first reference temperature;

determine that the temperature of the storage compartment has increased to a second reference temperature, the second reference temperature being higher than the first reference temperature, and operate the compressor again with a determined cooling power when the temperature of the storage compartment is determined to have increased to the second reference temperature, and wherein the operate of the compressor again includes:

determining the cooling power for the compressor based on an on slope and an off slope, the on slope being a temperature change slope of the storage compartment during an on time of the compressor, and the off slope being a temperature change slope of the storage compartment during an off time of the compressor; and operating the compressor at the determined cooling power, wherein the cooling power of the compressor is determined based on a comparison of a predetermined reference value and a slope ratio of the on slope to the off slope.

17. The refrigerator of claim 16, wherein when the slope ratio is equal to the reference value, the cooling power of the compressor is determined to be maintained at the predetermined cooling power, wherein when the slope ratio is larger than the reference value, the cooling power of the compressor is determined to be reduced to be less than the predetermined cooling power, and wherein when the slope ratio is less than the reference value, the cooling power of the compressor is determined to be increased to be more than the predetermined cooling power.

18. A refrigerator comprising:

a compressor configured to compress a refrigerant;

a first evaporator configured to receive the refrigerant from the compressor to generate cold air for cooling a first storage compartment;

a first temperature sensor configured to sense a temperature of the first storage compartment;

a second evaporator configured to receive the refrigerant from the compressor to generate cold air for cooling a second storage compartment;

a second temperature sensor configured to sense a temperature of the second storage compartment;

a first valve configured to open or close a first refrigerant passage connected between the compressor and the first evaporator to allow the refrigerant to flow therebetween;

a second valve configured to open or close a second refrigerant passage connected between the compressor and the second evaporator to allow the refrigerant to flow therebetween; and a controller configured to control the first valve, the second valve, and the compressor, wherein the controller is configured to:

operate a first cooling cycle for cooling the first storage compartment by turning on the compressor and opening the first valve and closing the second valve, and close the first valve when a stop condition of the first cooling cycle is satisfied, and operate the compressor and open the second valve in order to operate a second cooling cycle for cooling the second storage compartment, and wherein the controller is configured to determine the cooling power of the compressor in a next first cooling cycle based on information from a previous first cooling cycle, wherein the cooling power for a cooling cycle is determined based on an on slope of the first storage compartment and an off slope of the first storage compartment, the on slope being a temperature change slope of the first storage compartment during an opening time of the first valve, and the off slope being a temperature change slope of the first storage compartment during a closing time of the first valve, wherein the cooling power of the compressor in the next first cooling cycle is determined based on a comparison of a predetermined first reference value and a first slope ratio of the on slope of the first storage compartment and the off slope of the first storage compartment.

19. The refrigerator according to claim 18, wherein the controller is configured to determine the cooling power of the compressor in a next second cooling cycle based on information from a previous second cooling cycle, wherein the cooling power is determined based on an on slope of the second storage compartment and an off slope of the second storage compartment, the on slope being a temperature change slope of the second storage compartment during an opening time of the second valve, and the off slope being a temperature change slope of the second storage compartment during a closing time of the second valve.

* * * * *